US012185760B2

(12) United States Patent
Potter et al.

(10) Patent No.: US 12,185,760 B2
(45) Date of Patent: Jan. 7, 2025

(54) COMPONENT FOR VAPOR PROVISION SYSTEM

(71) Applicant: NICOVENTURES TRADING LIMITED, London (GB)

(72) Inventors: Mark Potter, London (GB); Richard Haines, London (GB)

(73) Assignee: NICOVENTURES TRADING LIMITED, London (GB)

( * ) Notice: Subject to any disclaimer, the term of this patent is extended or adjusted under 35 U.S.C. 154(b) by 835 days.

(21) Appl. No.: 17/309,203

(22) PCT Filed: Oct. 31, 2019

(86) PCT No.: PCT/GB2019/053091
§ 371 (c)(1),
(2) Date: May 6, 2021

(87) PCT Pub. No.: WO2020/095027
PCT Pub. Date: May 14, 2020

(65) Prior Publication Data

US 2022/0125106 A1 Apr. 28, 2022

(30) Foreign Application Priority Data

Nov. 9, 2018 (GB) ..... 1818270

(51) Int. Cl.
*A24F 40/46* (2020.01)
*A24F 40/44* (2020.01)
(Continued)

(52) U.S. Cl.
CPC ..... *A24F 40/46* (2020.01); *A24F 40/44* (2020.01); *A24F 40/485* (2020.01); *A24F 40/70* (2020.01)

(58) Field of Classification Search
CPC ..... A24F 40/44
See application file for complete search history.

(56) References Cited

U.S. PATENT DOCUMENTS 8,707,965 B2 4/2014 Newton
10,070,668 B2 * 9/2018 Li ..... A24F 40/40
(Continued)

FOREIGN PATENT DOCUMENTS

CN 104010537 A 8/2014
CN 104605482 A 5/2015
(Continued)

OTHER PUBLICATIONS

International Preliminary Report on Patentability for Application No. PCT/GB2019/053091, mailed on Jan. 26, 2021, 7 pages.
(Continued)

*Primary Examiner* — Ross N Gushi
(74) *Attorney, Agent, or Firm* — Husch Blackwell

(57) ABSTRACT

A component for a vapor provision system includes a boundary wall separating a reservoir for holding a fluid from a chamber for housing a vapor generator, the boundary wall including two or more adjacent rigid bodies sealed to one another; and a tubular aperture in the boundary wall providing a fluid transport path from the reservoir to the vapor generator; wherein the aperture is defined between the adjacent rigid bodies, the rigid bodies enclosing a perimeter of the aperture along at least part of aperture's length.

21 Claims, 5 Drawing Sheets

(51) Int. Cl.
*A24F 40/485* (2020.01)
*A24F 40/70* (2020.01)

(56) References Cited

U.S. PATENT DOCUMENTS

| | | | | |
|---|---|---|---|---|
| 10,617,152 | B2 * | 4/2020 | Force | A24F 40/44 |
| 11,382,357 | B2 * | 7/2022 | Voerman | A24F 40/46 |
| 11,684,084 | B2 * | 6/2023 | Force | A24F 40/42 392/404 |
| 2014/0109921 | A1 | 4/2014 | Chen | |
| 2014/0261487 | A1 | 9/2014 | Chapman et al. | |
| 2016/0073692 | A1 | 3/2016 | Alarcon et al. | |
| 2016/0076692 | A1 | 3/2016 | Sun et al. | |
| 2016/0192710 | A1 | 7/2016 | Liu | |
| 2016/0249681 | A1 | 9/2016 | Liu | |
| 2017/0020193 | A1 | 1/2017 | Davis et al. | |
| 2018/0020730 | A1 | 1/2018 | Alarcon et al. | |
| 2018/0084836 | A1 | 3/2018 | Perez et al. | |
| 2018/0310616 | A1 | 11/2018 | Clemens et al. | |

FOREIGN PATENT DOCUMENTS

| | | | |
|---|---|---|---|
| CN | 104839893 | A | 8/2015 |
| CN | 204670384 | U | 9/2015 |
| CN | 206620836 | U | 11/2017 |
| CN | 108244710 | A | 7/2018 |
| CN | 207855035 | U | 9/2018 |
| EP | 2870889 | A1 | 5/2015 |
| EP | 3039976 | A1 | 7/2016 |
| JP | 3164992 | U | 12/2010 |
| JP | 2015519903 | A | 7/2015 |
| JP | 2018038399 | A | 3/2018 |
| JP | 2021511021 | A | 5/2021 |
| KR | 20120098343 | A | 9/2012 |
| KR | 20140110855 | A | 9/2014 |
| RU | 107026 | U1 | 8/2011 |
| RU | 2613785 | C2 | 3/2017 |
| WO | 2016190222 | A1 | 12/2016 |
| WO | 2017021536 | A2 | 2/2017 |
| WO | WO-2017021550 | A1 | 2/2017 |
| WO | 2017093535 | A1 | 6/2017 |
| WO | 2017163052 | A1 | 9/2017 |
| WO | 2018050030 | A1 | 3/2018 |
| WO | WO-2018114380 | A1 | 6/2018 |
| WO | 2018130023 | A1 | 7/2018 |
| WO | WO-2018158566 | A1 | 9/2018 |
| WO | 2018193339 | A1 | 10/2018 |
| WO | 2018198093 | A2 | 11/2018 |

OTHER PUBLICATIONS

International Search Report and Written Opinion for Application No. PCT/GB2019/053091, mailed on Jan. 31, 2020, 13 pages.
"Decision to Grant received for Japanese Patent Application No. 2021-524062, mailed on Aug. 15, 2023", 5 pages (2 pages of English Translation and 3 pages of Official Copy).
"Notice of Reasons for Refusal received for Japanese Application No. 2021-524062, mailed on Aug. 2, 2022", 22 pages (11 pages of English Translation and 11 pages of Official Copy).
"Notice of Reasons for Rejection received for Japanese Application No. 2021-524062 mailed on Feb. 7, 2023", 15 pages (7 pages of English Translation and 8 pages of Official Copy).
"Office Action received for Korean Patent Application No. 10-2021-7013867, mailed on Apr. 6, 2023", 14 pages (7 pages of English Translation and 7 pages of Official Copy).

* cited by examiner

COMPONENT FOR VAPOR PROVISION SYSTEM

PRIORITY CLAIM

The present application is a National Phase entry of PCT Application No. PCT/GB2019/053091, filed Oct. 31, 2019, which claims priority from GB Patent Application No. 1818270.9, filed Nov. 9, 2018, each of which is hereby fully incorporated herein by reference.

TECHNICAL FIELD

The present disclosure relates to a component for a vapor provision system.

BACKGROUND

Vapor provision systems, such as electronic cigarettes, generate an inhalable vapor or aerosol from one or more substrate materials which may be in liquid or gel form. Such materials are typically stored in a reservoir or tank, and delivered to a vapor generator such as an electrical heating element which is housed in a vapor chamber. A wall or partition separates the interior of the reservoir from the vapor chamber, and one or more openings or apertures are provided in the wall by which fluid can travel from the reservoir to the vapor generator, often by capillary action in a porous wicking element extending through the aperture.

Fluid flow through these apertures should be managed to deliver the fluid at an appropriate rate. Excess flow through an aperture can result in the presence of free liquid in the vapor chamber, from where it can move to other parts of the system, causing leaks, damage and poor quality aerosol.

Approaches to inhibiting fluid leaks at reservoir apertures are therefore of interest.

SUMMARY

According to a first aspect of some embodiments described herein, there is provided a component for a vapor provision system comprising: a boundary wall separating a reservoir for holding a fluid from a chamber for housing a vapor generator, the boundary wall comprising two or more adjacent rigid bodies sealed to one another; and a tubular aperture in the boundary wall providing a fluid transport path from the reservoir to the vapor generator; wherein the aperture is defined between the adjacent rigid bodies, the rigid bodies enclosing a perimeter of the aperture along at least part of aperture's length.

According to a second aspect of some embodiments described herein, there is provided a vapor provision system comprising a component according to the first aspect.

According to a third aspect of some embodiments described herein, there is provided a component for a vapor provision system comprising: a boundary wall separating a reservoir for holding a fluid from a chamber for housing a vapor generator, and a curved tubular aperture in the boundary wall providing a fluid transport path from the reservoir to the vapor generator.

According to a fourth aspect of some embodiments described herein, there is provided a vapor provision system comprising a component according to the third aspect.

These and further aspects of the certain embodiments are set out in the appended independent and dependent claims. It will be appreciated that features of the dependent claims may be combined with each other and features of the independent claims in combinations other than those explicitly set out in the claims. Furthermore, the approach described herein is not restricted to specific embodiments such as set out below, but includes and contemplates any appropriate combinations of features presented herein. For example, a component may be provided in accordance with approaches described herein which includes any one or more of the various features described below as appropriate.

BRIEF DESCRIPTION OF THE DRAWINGS

Various embodiments of the disclosure will now be described in detail by way of example only with reference to the following drawings in which.

DETAILED DESCRIPTION

Figure 1:
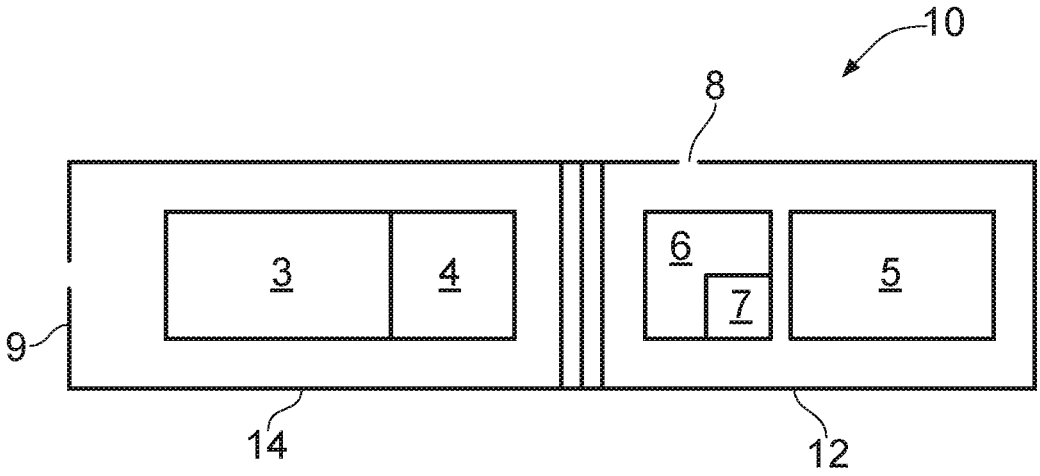
FIG. 1 shows a simplified longitudinal cross-sectional view of an example vapor provision system in which aspects of the disclosure may be implemented.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

As used herein, the terms "vapor provision device/system", "electronic vapor provision device/system", "aerosol provision device/system", "electronic aerosol provision device/system" and similar terms are intended to include non-combustible aerosol and vapor provision systems (non-combustible smoking articles) such as electronic smoking articles including electronic cigarettes or e-cigarettes that create vapor or aerosol from aerosolizable substrate materials by heating or other techniques such as vibration, heating devices that release compounds from substrate materials without burning such as tobacco heating products, and hybrid systems that generate aerosol from a combination of substrate materials, for example hybrid systems containing liquid or gel or solid substrates. The term "aerosol" may be used interchangeably with "vapor".

In some embodiments, the non-combustible aerosol or vapor provision system is a non-combustible smoking article such as an electronic cigarette, also known as a vaping device. The non-combustible aerosol provision system may comprise one or more components, such as a heater and an aerosolizable substrate. In some embodiments the system comprises a heater, a power supply capable of supplying power to the heater, an aerosolizable substrate such as a liquid or gel, a housing and optionally a mouthpiece. The aerosolizable substrate may be contained in a substrate container. The substrate container may be combined with or comprise the heater.

In some embodiments, the non-combustible aerosol or vapor provision system is a heating product which releases one or more compounds by heating, but not burning, a substrate material. The substrate material is an aerosolizable substrate material which may be, for example, tobacco or other non-tobacco products, which may or may not contain nicotine. In some embodiments, the product is a tobacco heating product. The tobacco heating product may comprise a heater, a power supply capable of supplying power to the heater, and an aerosolizable substrate such as a solid or gel material. The heating product may comprise an aerosolizable substrate such as a solid or gel material and a heat source which is capable of supplying heat energy to the aerosolizable substrate without any electronic means, such as by burning a combustion material, such as charcoal. The heating product may also comprise a filter capable of filtering the aerosol generated by heating the aerosolizable substrate.

In some embodiments, the non-combustible aerosol or vapor provision system is a hybrid system for generating aerosol by heating, but not burning, a combination of substrate materials. The substrate materials may comprise for example solid, liquid or gel which may or may not contain nicotine. In some embodiments, the hybrid system comprises a liquid or gel substrate and a solid substrate. The solid substrate may be, for example, tobacco or non-tobacco products, which may or may not contain nicotine. In some embodiments, the hybrid system comprises a liquid or gel substrate and tobacco.

The aerosol or vapor may be produced or released from a variety of substrates in various ways depending on the nature of the device, system or product. These include heating to cause evaporation, heating to release compounds, and vibration of a liquid or gel to create droplets. The substrate material, which may be one or more different materials within one system, may generally be referred to as an aerosol forming substrate, an aerosol forming substrate material, an aerosolizable substrate, an aerosolizable substrate material, or similar term. Substrate materials may be solid, liquid or gel, and may or may not comprise or include tobacco, and may or may not produce an aerosol or vapor containing nicotine. For example, the aerosolizable substrate material may comprise a vapor or aerosol generating agent or a humectant, such as glycerol, propylene glycol, triacetin or diethylene glycol.

Some embodiments of the disclosure are concerned with systems comprising two separable components that are connected together in use, namely a device component that may be reusable and a consumable component (such as a cartridge) that may be disposable or single use and which contains aerosolizable substrate material.

FIG. 1 shows a highly schematic and simplified diagram (not to scale) of an example aerosol/vapor provision or generation system such as an e-cigarette 10. The e-cigarette 10 has a generally elongate shape comprising two main components, namely a control or power component, section or unit 12, and a cartridge assembly or section 14, that operates as an aerosol generating component. In this example, the components are arranged end-to-end, but other arrangements are possible, such as a side-by-side arrangement. Also, the overall shape of the system need not be elongate.

The control or power component 12 may be referred to as a "device", and is typically configured to be reusable (although this is not essential) to provide a plurality of aerosol provision experiences to a user over a period of days, weeks, months or years. The cartridge assembly 14, which in some designs of system may be termed a "cartomizer", contains aerosolizable substrate material in the form of a liquid or gel, and is typically intended to be replaced when the substrate material has been used up, or consumed. Hence, this component 14 may be referred to as a "consumable component". In some examples, however, the consumable component may be configured to be refilled with substrate material when a first amount of substrate material has been consumed. The consumable component 14 may be intended to be replaced when other parts that may be contained within it reach an end of an operational lifetime, such as a heating element or a wicking component. In many examples, a single device will be able to be used with a plurality of consumable components which are replaced in sequence. In such a case, the operational lifetime of the device is intended to be longer than the operational lifetime of the consumable component. This is not essential, however, and the device may also be designed as a replaceable part, with a relatively short operational lifetime.

The consumable component 14 includes a supply of aerosolizable substrate material 3 in the form of a liquid or a gel which is stored in a reservoir or other storage volume. The substrate material is material from which an aerosol is to be generated, which may or may not be an aerosol containing nicotine. One or more flavorants may be included in the substrate. The consumable component 14 also comprises an atomizer (vaporizer) 4 operable to generate aerosol from the substrate material 3. The nature of the atomizer 4 will be appropriate to the format of the substrate material 3. Examples include an electrical heating element (operable by resistive heating or inductive heating) to which the substrate material is delivered by a wicking, capillary or other liquid transport arrangement for the liquid or gel to be vaporized, and a vibrating perforate sheet to which liquid or gel is delivered for droplet generation. A wide variety of vaporizer or atomizer configurations or assemblies able to generate vapor from aerosolizable substrate material delivered to the atomizer are known or will be readily apparent to the skilled person. In general, however, in the context of the present disclosure the atomizer 4 has the form of a chamber (vapor chamber) which houses a vapor generator or vapor generating element (such as the electrical heating element or the vibrating perforate sheet mentioned above) and is defined by a surrounding wall which separates the chamber from the reservoir holding the aerosolizable substrate material.

The consumable component 14 also includes a mouthpiece 9 having an opening or air outlet through which a user may inhale the aerosol generated by the atomizer 4.

The device 12 provides power and control for generation of aerosol by the atomizer 4 from the aerosolizable substrate material 3. Hence, the device 12 includes a cell or battery 5 (referred to herein after as a battery, and which may be re-chargeable) to provide power for electrical components of the e-cigarette 10, such as the atomizer 4. Additionally, there is a controller 6 such as a printed circuit board and/or other electronics or circuitry for generally controlling the e-cigarette. The controller 6 includes (or may be) a processor 7 (a microprocessor executing software, or electronics configured to perform the functions of a processor). The controller 6 connects the atomizer 4 to the battery 5 when vapor is required, for example in response to a signal from an air pressure sensor or air flow sensor (not shown) that detects an inhalation on the system 10 during which air enters through one or more air inlets 8 in a wall of the housing of the device 20 (or a wall of the consumable component 14 in other examples). When the atomizer 4 receives power from the battery 5, the atomizer 4 operates to generate vapor from the aerosolizable substrate material 3, and this forms an aerosol to be inhaled by a user through the opening in the mouthpiece 9. The aerosol is carried from the atomizer 4 to the mouthpiece 9 along an air channel (not shown) that connects the air inlet 8 to the atomizer 4 to the air outlet when a user inhales on the mouthpiece 9.

In the FIG. 1 example, the device 12 and the consumable component 14 are separate connectable sections detachable from one another by separation in a direction parallel to the longitudinal axis (in this example), as indicated by the solid arrow in FIG. 1. The components 12, 14 are joined or coupled together when the system 10 is in use by cooperating engagement elements 16, 18 (for example, a screw or bayonet fitting) which provide mechanical and electrical connectivity between the device 12 and the consumable component 14. This is merely an example arrangement, however, and the various elements may be differently distributed between the device 12 and the consumable component 14, and other parts and elements may be included. The two sections may connect together for use end-to-end in a longitudinal configuration as in FIG. 1, or in a different configuration such as a parallel, side-by-side arrangement. The system may or may not be generally cylindrical and/or have a generally longitudinal shape. Either or both sections or components 12, 14 may be intended to be disposed of and replaced when exhausted (the reservoir is empty or the battery is flat, for example), or be intended for multiple uses enabled by actions such as refilling the reservoir and recharging the battery. In other examples, the system 10 may comprise its components within a single housing that provides the device functionality and the consumable component functionality in a single unitary system. A unitary system may be a disposable, single use system, or be configured for multiple uses by battery recharging or replacement and reservoir refilling. Embodiments and examples of the present disclosure are applicable to any of these configurations and other configurations of which the skilled person will be aware.

Figure 2:
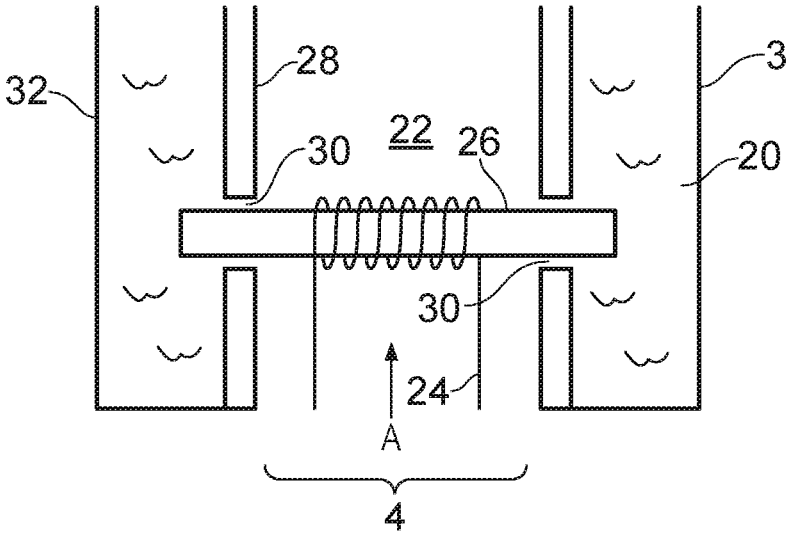
FIG. 2 shows a simplified cross-sectional view of an example vapor chamber of a vapor provision system.

FIG. 2 shows a schematic cross-sectional view through a configuration of a vapor chamber. An atomizer 4 comprises a heating element 24 in the form of a heating coil, which is connectable to an electrical supply (not shown) for the provision of electrical power to generate heat by the Joule effect, and a wick element 26 around which the coil is wound. The wick 26 is a porous element able to absorb liquid and propagate liquid by capillary effects. The atomizer 4 is housed in a vapor chamber 22, which has a boundary wall 28 defining the sides of the chamber 22. A reservoir 3 surrounds the chamber 22, and provides an annular storage volume defined between the boundary wall 28 and an outer wall 32 for holding source liquid or gel 20 (aerosolizable substrate material). The boundary wall has two opposing apertures 30 formed at opposite sides of the chamber 22, through which the two ends of the wick 26 extend so as to reach into the storage volume of the reservoir 3. In this way the wick 26 comes into contact with the liquid 20.

The chamber 22 is open at its upper and lower ends (in the depicted orientation), and is comprised within an airflow path though a vapor provision system. The air flow path extends from one or more air inlets (such as inlet 8 in FIG. 1) in the system's housing, through the chamber 22, to an outlet in a mouthpiece (such as mouthpiece 9 in FIG. 1). In use, the wick absorbs liquid 20 from the reservoir, and carries it to the vicinity of the heating element 24. When the heating element is powered, it generates heat which vaporizes the volatile liquid held in the wick 24 to produce a vapor in the vapor chamber. Air flow A along the air flow path passes through the chamber 22, over the heater 24 and the wick 26 and gathers the vapor, some of which typically condenses to form an aerosol. The vapor and/or aerosol is carried by the air flow to the mouthpiece for inhalation by a user.

The FIG. 2 arrangement is merely exemplary; the various components may have different shapes, configurations and relative physical positions.

The form of the apertures 30 in the boundary wall 28 by which the wick 26 extends into the reservoir is of interest. The apertures 30 may be formed as simple holes drilled, punched or otherwise made in the boundary wall 28. In other arrangements, the boundary wall 28 is formed from two or more shaped parts or components which abut one another with a space between the parts to provide an aperture. It is desirable to minimize leakage of liquid from the reservoir through the apertures, to avoid the presence of free liquid in the vapor chamber and therefore also in the air flow channel. Such free liquid can exit the system through the mouthpiece, or move against the air flow direction to leak from the system or come into contact with electrical components, causing damage. Some degree of sealing at the aperture/wick interface is therefore desirable. The seal should not be too tight or complete, though, since air must be able to enter the reservoir to balance pressure inside and outside the reservoir to maintain the flow of liquid to the atomizer. Also, a very tight seal might overly compress the wick and restrict liquid movement along the wick. Too loose a seal will enable free liquid leakage. Accordingly, the size and shape of the aperture relative to the wick passing through it is important, and should be selected with care to enable efficient liquid transport along the desired liquid flow path from reservoir to heating element, without excess liquid escaping into the chamber.

In designs where the boundary wall is formed from abutting adjacent parts, compliant or resilient materials such as rubber and silicon are popular for one or more of the parts. The compressible nature of these materials allow the required aperture to be formed when the parts are assembled together, with a degree of sealing around the wick to inhibit excess fluid from the reservoir escaping around the wick as a leak. However, the compressible nature also tends to mean that the formation of the aperture, and hence the fit of the aperture around the wick, can be inconsistent, both in terms of deviation from the intended design, and in variation between devices. In the assembled system, the aperture can potentially be too large or too small compared to the intended size. A large aperture can allow free liquid leakage into the chamber, and a small aperture can restrict liquid flow out of the reservoir, and restrict air flow into the reservoir which is necessary to replace consumed liquid to enable further outward liquid flow. Either of these conditions can reduce the amount of liquid available in the wick in the vicinity of the heating element, for vapor generation. A drier wick is susceptible to burning when exposed to the heat produced by the heating element, which is dangerous, and can contaminate the generated vapor.

Accordingly, the present disclosure proposes particular features for providing an aperture or apertures by which fluid is transported from a reservoir to a vapor generator. It is proposed that the boundary wall between the reservoir and the vapor chamber be formed from bodies made from rigid material (also "rigid bodies") which are abutted against one another, or made adjacent, and are shaped so that when abutted an aperture or apertures are defined between the abutted bodies.

Figure 3:
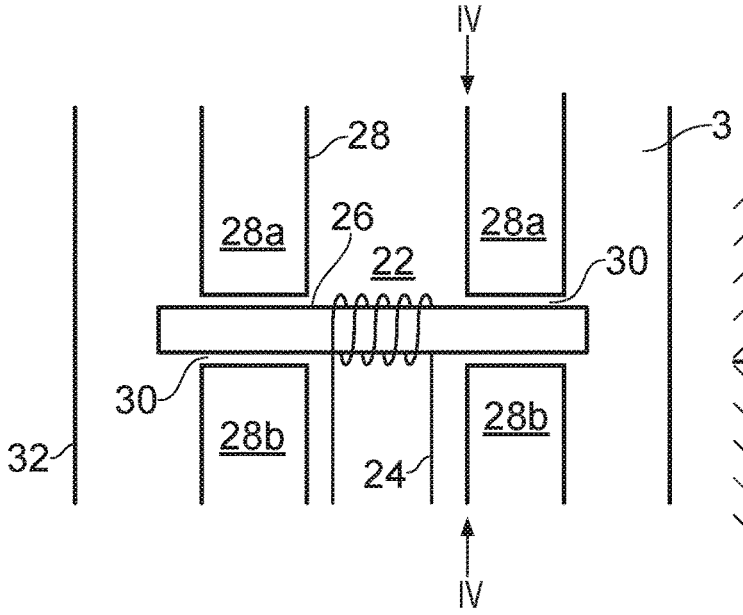
FIG. 3 shows a simplified cross-sectional view of an example vapor chamber according to the present disclosure, comprising linear apertures and wick.

FIG. 3 shows a simplified cross-sectional view through an example vapor chamber and reservoir arrangement. Many parts are as previously described with regard to FIG. 2, and like reference numerals are used for like parts; the description of these parts will not be repeated in detail. As before, a boundary wall 28 is provided to separate the vapor chamber 22 from the reservoir 3, where the vapor chamber 22 is centrally disposed within the annular reservoir 3. Two apertures 30 extend through the boundary wall 28, one on each side of the chamber 22 in an opposite disposition. Each aperture 30 provides a pathway for fluid flow or fluid transport of liquid from the interior of the reservoir 3 to the heating element 24 (the vapor generator being implemented as a heating coil in this example), where in this example the fluid flow is controlled and managed by a wick or wicking element 26 accommodated in the apertures 30. A central portion of the wick 26 lies in the chamber and is encircled by the coils of the heating element 24, and the two opposite end portions of the wick pass into and through the apertures 30 and extend into the reservoir 3. The wick 26 is a porous element or member which is configured to absorb liquid from the reservoir 3 and transport that liquid by wicking or capillary action through pores in the wick 26 to the vicinity of the heating element 24. As liquid at or near the heating element 24 is driven off as vapor, the wicking effect pulls new liquid through the porous network of the wick material towards the central portion so that a constant supply of liquid is available for vapor production. The wick may comprise any suitable porous material, selected for example with reference to its wicking capability as regards the particular qualities of the aerosolizable substrate material (liquid or gel) in the reservoir, such as viscosity. For example, the wick may comprise cotton, as a single strand, a plied yarn, or a bundle, twist or other grouping of strands or yarns. Other fibers may be used together with or instead of cotton, such as glass fiber or other natural fibers or man-made fibers. Other porous materials such as sponge materials and porous ceramics may also be used.

The boundary wall 28 is formed from two rigid bodies which are placed adjacent to each other in an abutting configuration. A first rigid body 28*a* defines the boundary wall 28 above the apertures 30 and a second rigid body 28*b* defines the boundary wall 28 below the apertures 30. The rigid bodies 28*a*, 28*b* therefore each have a generally tubular or annular shape comprising a wall, partition or housing around a central void or cavity open at each end, so that when the rigid bodies 28*a*, 28*b* are abutted end-to-end by bringing facing end surfaces into contact, the central voids combine to form a continuous central void or space which is the vapor chamber 22 for the vapor provision system, and possibly also parts of the air flow channel upstream and downstream of the vapor chamber 22. The edges of the rigid bodies 28*a*, 28*b* which are abutted are shaped such that when the edges are assembled together to build the boundary wall 28 and hence the chamber 22, an open space is left between the edges which provides an aperture 30. In this example, the rigid bodies 28*a*, 28*b* have a thickness, being a dimension generally orthogonal to the plane of the boundary wall 38, and along the direction of the fluid transport path provided by the apertures 30, sufficient to form apertures 30 which are elongate, in that their length (dimension along the fluid flow direction) is greater than their width (dimension orthogonal to the fluid flow direction). For example, the length may be two times the width, or more than two times the width. The apertures may be considered as being tubular, or having the form of hollow closed channels. This elongate nature can aid in reducing leakage of liquid through the apertures 30, since the wick 26 is enclosed by the apertures 30 over a larger distance.

Figure 4A:
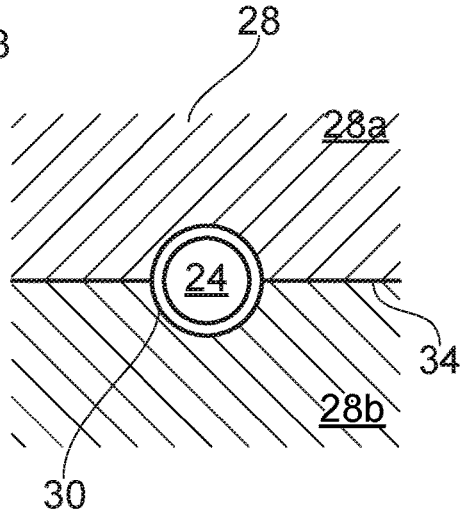
FIGS. 4A, 4B and 4C show example configurations of a boundary wall included in the vapor chamber of FIG. 3.

FIG. 4A shows a plan view of an example of the boundary wall 28 along the line IV-IV in FIG. 3. The first or upper rigid body 28*a* and the second or lower rigid body 28*b* are both shaped on their abutting edges to define the opening for the aperture 30, in which the wick 24 is accommodated. Each rigid body 28*a*, 28*b* has a semi-circular open channel or recess in the face of its abutting edge, which when brought together form a circular closed channel or tube, providing the aperture 30. The two rigid bodies 28*a*, 28*b* therefore completely enclose the perimeter of the aperture 30, and in this example, this enclosure is present over the whole length or elongate extent of the aperture, as can be appreciated from FIG. 3.

The rigid bodies 28*a*, 28*b* are sealed or secured together at their abutting edges, rather than simply being placed in adjacent contact. This securing, along a join or joint 34 where the faces of the abutting edges come together, acts to maintain the shape and size of the aperture, thereby enhancing the consistency of the aperture dimensions, and seals the rigid bodies together to inhibit the passage of liquid other than through the apertures 30. The securing may be achieved in any of a number of ways, where the selected technique may be chosen with regard to the nature of the material or materials used for the rigid bodies. For example, ultrasonic welding may be used to fuse the materials of the abutting bodies together once they are assembled. Adhesive may be applied to one or both abutting faces before the rigid bodies are assembled together, so that the securing is achieved by gluing. The securing is applied along the full extent of the abutted faces, so as to provide a liquid-tight seal between two adjacent rigid bodies, so that liquid can only travel out of the reservoir via the apertures.

The apertures may have any cross-sectional shape, and are not limited to the circular shape shown in the example of FIG. 4A. The rigid material of the rigid bodies combined with the secure leak-proof joining of the rigid bodies provides a consistent and stable aperture size and aperture location, so that liquid flow out of the reservoir can be accurately regulated. The flow of liquid to the heating element is regulated during use of the system for vapor provision, and the aperture properties inhibit leakage when the system is inactive. The aperture size, shape and location are not affected by the assembly process, again owing to the rigid nature of the material used to form the boundary wall, so that product-to-product consistency is enhanced.

Figure 4B:
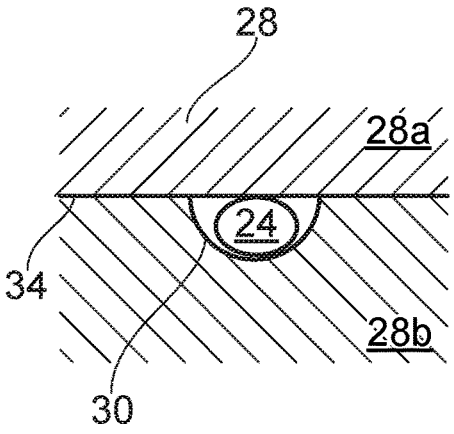

FIG. 4B shows a further example in plan view along the line IV-IV of FIG. 3. In this example, the first rigid body 28*a* has no shaping on its abutting edge at the joint 34, whereas the second rigid body 28*b* has a semi-circular open channel as in the FIG. 4A example. Hence, when the rigid bodies 28*a* and 28*b* are assembled together, the flat surface of the first rigid body overlies and closes the open channel on the second rigid body, to form a closed channel or tube of semi-circular cross-section, this being the aperture 30. The wick 24 may be of a similar cross-sectional shape, or may be compressed from some other shape, such as circular, in order to be accommodated within the aperture 30.

Figure 4C:
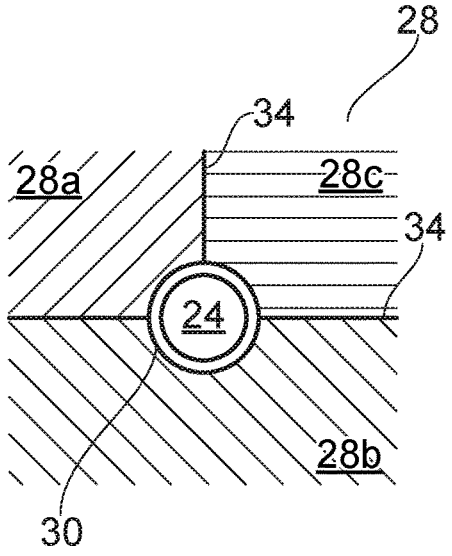

FIG. 4C shows a still further example in plan view along the line IV-IV of FIG. 3. In this example, three rigid bodies 28*a*, 28*b* and 28*c* are brought together to form the boundary wall 28. The aperture 30 is formed at the junction between the three rigid bodies 28*a*, 28*b*, 28*c*, each of which has shaping on its abutting edge face to define a circular cross-section aperture 30 when the bodies are assembled together and secured along the joints 34. Other configurations of multiple rigid bodies might also be used, such as separate rigid bodies for opposite sides of the boundary wall, where some joints between the rigid bodies would be separated from the aperture locations, so the relevant edge surfaces would not include shaping to define an aperture.

The rigid bodies may be made from any suitable rigid material. By "rigid", it is meant that the material lacks pliancy, elasticity or deformability to any discernible extent in use; when the rigid bodies are assembled together they form a solid structure that maintains its volume and shape and is not deformable or compressible under regular conditions of use of the vapor provision system. In this way, the shape, size and position of the aperture is maintained. Suitable materials includes plastics, such as polybutylene terephthalate (PBT), thermoplastics, and reinforced plastics and thermoplastics, for example reinforced with glass fiber. An example is Grivory® HT1V-4 FWA, a 40% glass fiber reinforced thermoplastic based on a semi-crystalline, partially aromatic copolyamide which is made by EMS-Grivory, and has good performance at high temperature as regards stiffness, strength, distortion stability and chemical resistance, which are all valuable properties in the environment of a vapor chamber. Examples of plastics include PEEK (polyether ether ketone), polypropylene, and copolyesters which have good strength and mechanical properties that are retained even under chemical exposure; an example is Tritan® made by Eastman Chemical Company. Other materials include metals and glass materials. Laser welding may be used to secure the rigid bodies in the case of metals and glasses. Further examples of suitable rigid materials are non-porous ceramics. All rigid bodies forming the boundary wall may be formed from the same rigid material. Alternatively, different rigid bodies may be formed from different materials. This could be useful having regard to different relationships between the rigid bodies and other components of the vapor provision system, for example.

Any number of rigid bodies can be used to form the boundary wall, although two bodies, one defining one side of the aperture's perimeter and one defining the other side of the aperture's perimeter, require the least amount of assembly work. The aperture can have any cross-sectional shape, and indeed may have a cross-sectional shape and/or area that varies along the length of the aperture.

For ease of assembly, the relevant portion of the wick can be placed into the shaping on one of the rigid bodies that will define the aperture before the rigid bodies are brought together for securing. Hence, when the rigid bodies are assembled together, the wick is already installed in the aperture. This is convenient if the wick has a same or similar cross-sectional size to the aperture, or if the wick has a larger cross-section so that it is compressed when accommodated in the aperture. Alternatively, the end of the wick can be inserted into or threaded through the aperture after the boundary wall has been formed by securing the rigid bodies together.

In the examples discussed thus far, the apertures are arranged as an oppositely disposed pair across the vapor chamber, and have a straight configuration, in that the longitudinal axis of each tubular aperture is linear, and also substantially perpendicular to the plane of the boundary wall. Accordingly, the wick is held in a linear configuration, with its longitudinal axis arranged substantially along a straight line. This line is orthogonal to the direction of airflow through the vaporization chamber. The wick may be made of a material of sufficient stiffness that it has this linear shape in its own right, or if the wick material is less rigid, the wick can be held straight by its insertion in the straight format of the pair of apertures.

However, the disclosure is not limited in this regard. The apertures may alternatively have a shape which is non-linear. In other words, the longitudinal axis of an aperture may not lie along a straight line; the aperture may be curved, including one or more bends.

Figure 5:
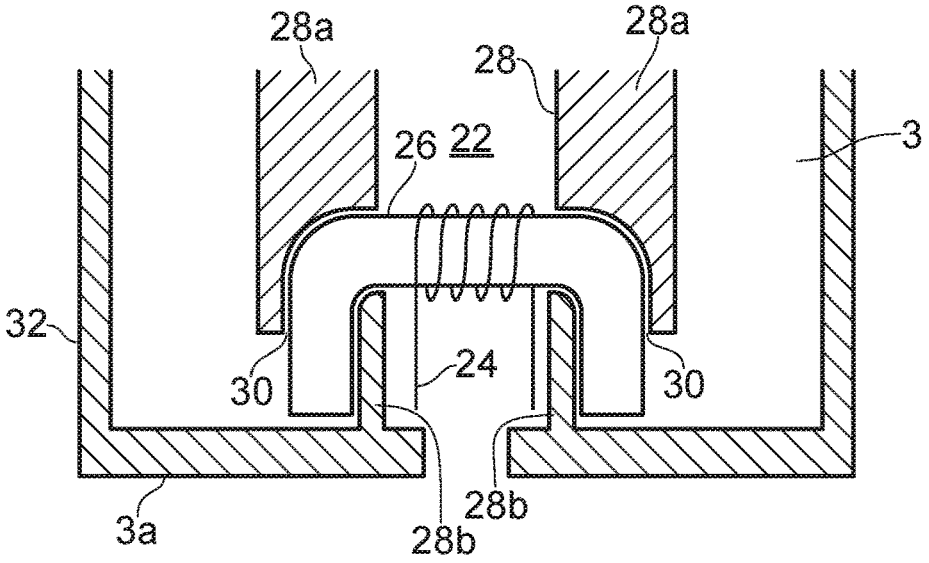
FIG. 5 shows a simplified cross-sectional view of a further example vapor chamber according to the present disclosure, comprising curved apertures and wick.

FIG. 5 shows a simplified cross-sectional view of a further example of a vapor chamber, with like parts again labelled with the same reference numerals. In this example, the boundary wall 28 between the reservoir 3 and the vapor chamber 22 is formed from an upper rigid body 28*a* and a lower rigid body 28*b*. The rigid bodies 28*a*, 28*b* are shaped on their abutting surfaces such that when they are assembled together, an aperture 30 is formed which has a curved or bent shape. A similar aperture 30 is provided on each side of the chamber 22 so that a single wick 26 can be accommodated across the chamber 22 with each end portion in the reservoir and the central portion with the heating element 24 disposed in the chamber perpendicular to the air flow direction, as before. In the depicted orientation, each aperture 30 has a curved tubular shape with an opening (cross-section) at the aperture end leading into the chamber 22 which lies in the plane of the boundary wall 28, and an opening (cross-section) at the opposite aperture end leading into the reservoir 3 which lies in a perpendicular plane. The aperture 30 has a bend in its central portion which is substantially a right angle, so that its two ends are perpendicular as noted. In this example, the lower rigid body 28*b* extends outwardly below the level of the wick to define a base wall 3*a* of the reservoir 3 before turning vertically upwards to define an outer wall for the annular reservoir 3. This provides a simple structure, but these various parts may alternatively be formed from various separate components instead.

Figure 5A:
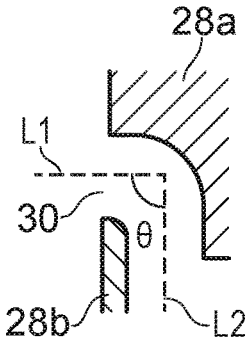
FIG. 5A shows a cross-sectional view of an aperture included in the vapor chamber of FIG. 5.

FIG. 5A shows a longitudinal cross-sectional view of the curved aperture 30 of FIG. 5. As described, the aperture 30 is defined between the abutted, opposing edge surfaces of an upper or first rigid body 28*a* and a lower or second rigid body 28*b*. The aperture 30, being elongate, has a tubular configuration, with a longitudinal axis L. A first portion of the length or longitudinal extent of the aperture 30 connects with the chamber 22, and a second portion of the length or longitudinal extent of the aperture 30 connects with the reservoir 3. The first portion has a longitudinal axis L1 and the second portion has a longitudinal axis L2, and in this example the two longitudinal axes lie an angle θ to one another of substantially 90 degrees, since the aperture 30 has a right-angled bend or turn in it. However, the feature is not limited to a right angle. An aperture with a bend may comprise an angle θ between the axes of first and second portions which is less than 180 degrees. If the right-angled arrangement is generally preferred, the angle might lie in the range of 80 to 100 degrees, for example, or in the range of 85 to 95 degrees. In the FIG. 5 example, the two oppositely disposed apertures have the same shape and curvature, but this is optional; two apertures for accommodating two ends of the same wick might have different bend angles (angles of curvature) and/or different bend directions, or one aperture may be curved and the other aperture may be straight as in the FIG. 3 example. Also, an aperture may comprise more than one curve or bend along its longitudinal extent.

The curved or bent shape of the aperture accommodates a wick in a similarly curved or bent orientation. The wick may be formed into such a shape in advance if it is made from a relatively stiff material, or may be given the curved shape by virtue of its fit within the curved aperture.

The curved or bent aperture may assist in protecting against leakage from the reservoir via the aperture, since the liquid flow path is made more tortuous and less direct. Also, the same length of wick may be accommodated within a narrower widthways extent across the system, so the external dimensions of the system can be smaller if desired. Also, if the curvature is towards the base of the reservoir, as in FIG. 5, the wick ends can reach closer to the base wall 3*a* of the reservoir 3 for better absorption of all liquid from the reservoir, while the heating element 24 can still be positioned centrally in the vapor chamber 22. Hence, there are a number of features offered by an arched wick shape, enabled by an arched or curved aperture arrangement, which can be attractive in various circumstances.

An atomizer in a vapor provision system need not comprise a wick or similar porous element for transporting liquid from a reservoir to a vapor generator such as the heating coil of the preceding examples. Capillary action to draw liquid out of the reservoir and deliver it into the vapor chamber for vaporization can be achieved by one or more capillary channels, being slots, channels, openings and the like which are dimensioned on a sufficiently small scale that the capillary effect takes place. Accordingly, the boundary wall apertures described herein may not be configured to accommodate a wicking element, but may instead have a smaller cross-sectional area of a size to produce capillary action. Such apertures may be curved or straight, as described. The operation of such capillary apertures can be enhanced by the use of the described rigid bodies. The improved consistency of aperture shape, size and location which is enabled by the rigid materials is valuable in the context of forming small channels, since tolerance to manufacturing errors is less for smaller-scale features.

In the examples discussed thus far, the perimeter of the or each aperture has been wholly defined and enclosed by the rigid material of abutting and secured rigid bodies at all points along the length of the aperture. The term "perimeter" is intended to describe the closed path or line of the side wall enclosing the aperture, where the side wall surrounds and defines the bore of the aperture since the aperture has a tubular shape. The perimeter is the boundary of the transverse cross-section of the aperture, in the plane perpendicular to the longitudinal axis. In other examples, the rigid material may enclose the full extent of the perimeter for only a part or portion of the length of the aperture. In another part or portion, an additional component, of a non-rigid material, may define part of the perimeter. This component may be, for example, an element such as a gasket formed from resilient material and placed between the rigid bodies in the vicinity of the aperture.

Figure 6:
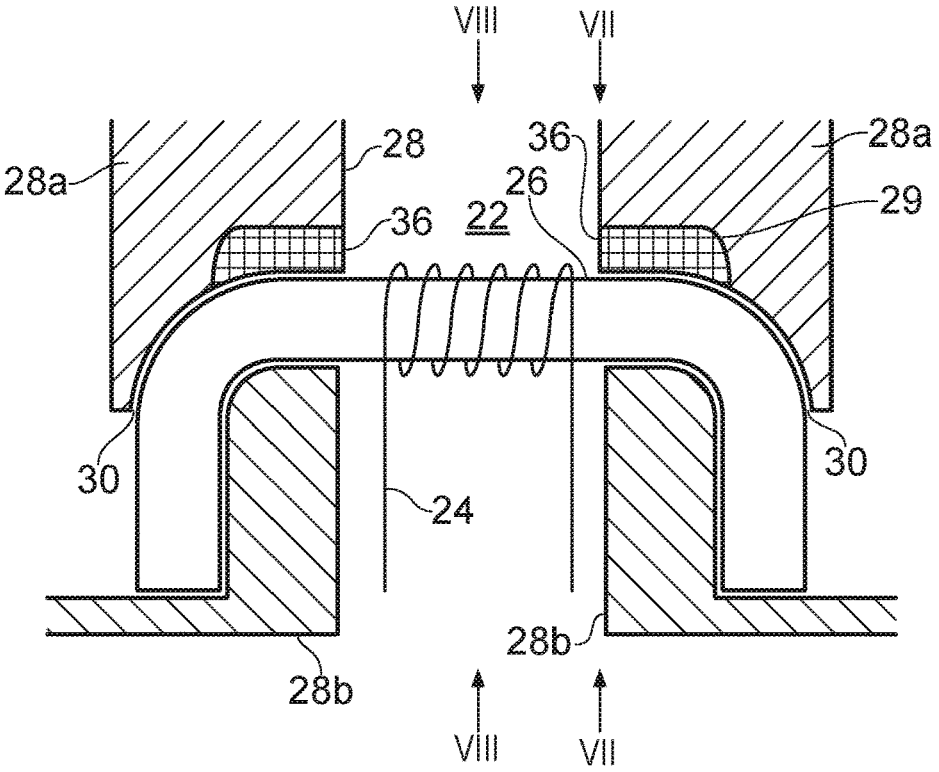
FIG. 6 shows a simplified cross-sectional view of another example vapor chamber according to the present disclosure, comprising a gasket.

FIG. 6 shows a simplified cross-sectional view of an example vapor chamber that includes a gasket. The component is configured in substantially the same way as that of the FIG. 5 example with, additionally, a gasket 36 included. The gasket 36 is placed against the abutting surface of the upper rigid body 28*a* across the area which defines the aperture 30, and extending beyond the width of the aperture. As shown, the gasket 36 sits in a recess 29 formed in the abutting surface of the upper rigid body 28*a*, so as not to protrude into the volume intended for the aperture. The lower rigid body 28*b* is abutted against the upper rigid body 28*a* as before, and contacts the gasket 30 in the border region around the aperture 30, and the upper rigid body itself elsewhere.

Figure 7:
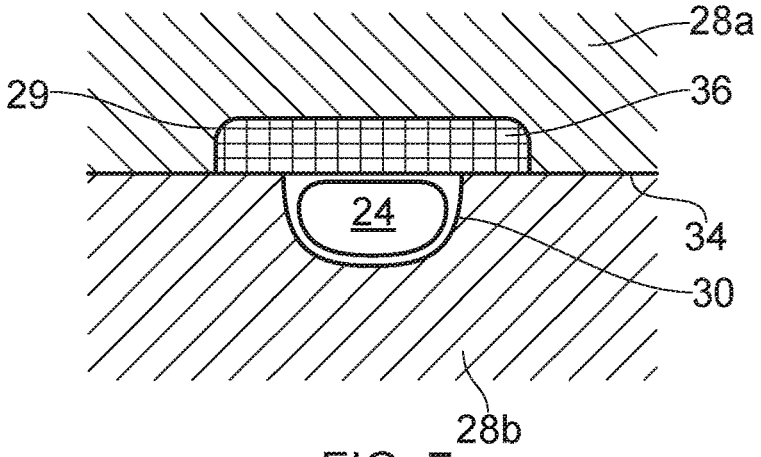
FIG. 7 shows an example configuration of a boundary wall included in the vapor chamber of FIG. 6.

FIG. 7 shows a plan view of the boundary wall 28 along the line VII-VII in FIG. 6, from which the arrangement of the gasket 30 may also be appreciated. The gasket 30 fills a recess in the abutting surface of the upper rigid body 28*a*, where the recess is wider than a channel in the abutting surface of the lower rigid body 28*b* which defines the aperture 30. Thus, the joint 34 is between the rigid bodies 28*a*, 28*b* directly at locations remote from the aperture 30, and may be secured by ultrasonic welding or gluing as before, whereas the joint is between the lower rigid body 28*b* and the gasket 36 immediately adjacent to the aperture 30. The gasket 36 extends across the width of the aperture 30. Hence, the perimeter of the aperture 30 is defined partly by the gasket and partly by the rigid material at the location of the opening of the aperture 30 into the chamber 22, and also over a first longitudinal portion of the aperture, according to the inward extent of the gasket shown in FIG. 6. Beyond this, the perimeter of the aperture 30 is wholly defined by the rigid material of the rigid bodies, as can be seen in FIG. 6. In an alternative, the gasket or other resilient element may be positioned so as define part of the aperture perimeter at some longitudinal position along the aperture length which is separated from the end of the aperture that opens into the vapor chamber.

The securing of the rigid bodies to one another to effect sealing can be carried out over those areas where the material of the rigid bodies is in contact at the joints between two rigid bodies. Where the gasket contacts the opposite rigid body around the aperture, sealing is provided by the resilient nature of the gasket material. The gasket may be formed from silicone, for example. Other suitable materials for the gasket include thermoplastic elastomers (TPEs) and thermoplastic polyurethane (TPU), but other resilient materials are not excluded. The presence of silicone or a similar resilient, compressible material, around a portion of the aperture's perimeter can assist in sealing around the wick 24 as it sits in the aperture.

As an alternative, the gasket may extend further or much further beyond the width of the aperture. Indeed, the gasket may extend so far as to be ring-shaped (circular or non-circular) and disposed between the upper and lower rigid bodies so that it completely encircles or circumscribes the vapor chamber. In such a case, the joint between the upper and lower rigid bodies can be completely filled with the gasket material all around the inner surface of the boundary wall. The gasket material can act to provide a liquid-tight seal between the rigid bodies, so that bonding such as by ultrasonic welding or gluing is not necessary. The gasket material provides the effect of securing of the rigid bodies to each other, in that it seals the rigid bodies together and achieves the same results as welding, gluing and the like. Beyond the outward extent of the gasket (in other words, outside the ring), the rigid bodies are in contact as before, providing the stability to achieve a consistent aperture size, shape and position. To enhance the sealing effect of the gasket, and to place and hold it in the correct position, it may be formed with protrusions and/or recesses which engage with corresponding recesses and/or protrusions in the rigid bodies.

Figure 8:
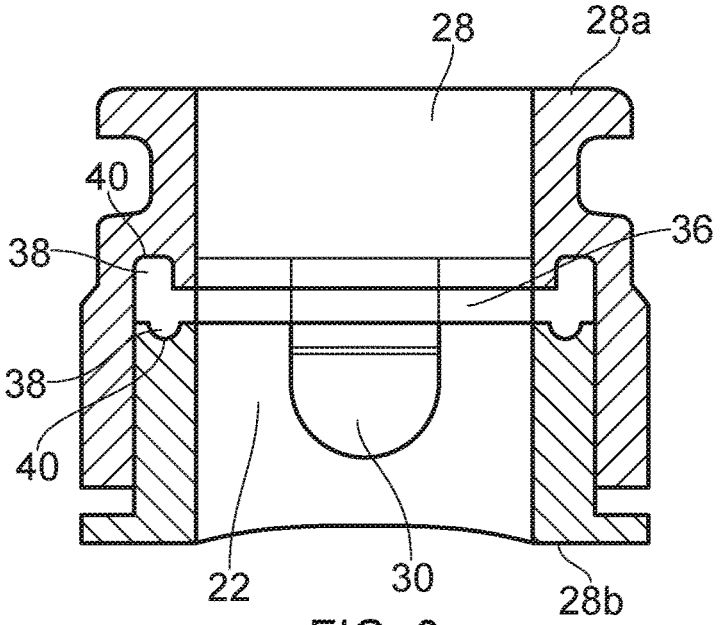
FIG. 8 shows a view from an orthogonal cross-section through an example vapor chamber which may be configured as the FIG. 6 example.

FIG. 8 shows a sectional view through a vapor chamber configured similarly to the FIG. 6 example, viewed from the line VIII-VIII and looking towards the aperture 30. The wick and the heating element are removed for clarity. The gasket 36 is in the form of a ring, extending around the whole perimeter of the vapor chamber 22, and sandwiched between the top of the lower rigid body 28*b* and the base of the upper rigid body 28*a* so that an inward facing surface of the ring forms part of the boundary wall 28 and creates a seal between the two rigid bodies 28*a*, 28*b*. The upper surface and lower surface of the gasket 36 have protruding features 38 formed on them; these features may be continuous or discrete around the ring-shape. The facing surfaces of the upper and lower rigid bodies 28*a*, 28*b*, which would abut in the absence of the gasket 36, are provided with recesses 40 which match the shape of the protrusions 38 on the gasket and receive the protrusions when the boundary wall is assembled, so that the three parts engage together. The protrusions 38 and recesses 40 may be reversed, and/or differently shaped and positioned.

Shaped engaging, latching or clipping cooperating surface features may also be provided between the rigid bodies to assist with securing them together and reinforcing the sealing effect of the gasket by holding it more securely or tightly in position, including possible compression of the gasket. Such an arrangement might be used as an alternative to welding or gluing. The rigid bodies could then be assembled by simply pushing them together to achieve a "snap fit" or clipping action between the cooperating features. If a very tight abutment can be achieved by this approach, it may be possible to rely only on the engagement of such cooperating features to seal the bodies together, with no need for welding, gluing or a gasket.

The gasket can be assembled with the bodies by placing it into a recess on a facing surface of one or other rigid body shaped to receive it, or simply overlying it on a facing surface, and then bringing the other rigid body into the abutting position.

Figure 9:
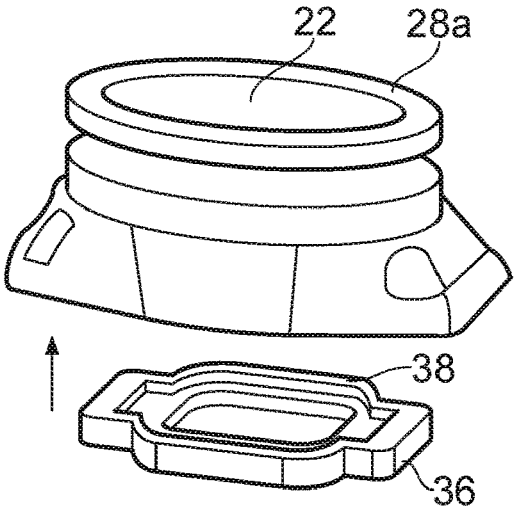
FIG. 9 shows a perspective view of an example of a boundary wall upper rigid body and gasket for a vapor chamber.

FIG. 9 shows an external perspective view of an example upper rigid body and gasket, prior to assembly. The upper body 28*a* has a detailed molded external shape with features intended for cooperation with other components of the vapor provision system. Overall, it has a generally annular shape, with a central through-cavity open at the top and bottom to define part of the vapor chamber 22. The gasket 36 is ring-shaped, with a central opening corresponding to the boundary wall of the vapor chamber 22 defined by the upper rigid body 28*a*. The gasket 36 has an upwardly protruding contiguous rim 38, being a surface feature for engagement into a corresponding recess in the upper rigid body 28*a* when the gasket is pressed up into the upper rigid body, as shown in FIG. 8.

Figure 10:
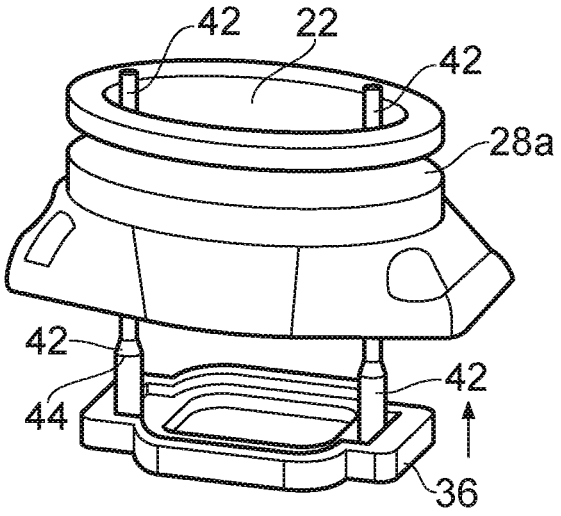
FIG. 10 shows a perspective view of a further example of a boundary wall upper rigid body and gasket for a vapor chamber.

FIG. 10 shows an external perspective view of another example upper rigid body and gasket, prior to assembly. The upper body 28*a* has the same exterior form as the FIG. 9 example. The gasket 36 also has the same form as the FIG. 9 example, except for the addition of two legs 42, which provide the function of pull-tabs. The legs 42 are provided on opposite sides of the upper surface of the gasket 36, towards the location of the upper rigid body 28*a*, and each has the form of a long, thin substantially straight extending part, having a length greater than the depth of the upper rigid body 28*a* along the same direction. The upper rigid body has two narrow through-holes (not visible) along this same direction which are aligned with the position of the legs 42. To assemble, the legs 42 are pushed or pulled through the through-holes, and the ends of the legs 42 can be grasped and used to pull the gasket 36 fully into its intended position against the facing surface of the upper rigid body 28*a*. The legs 42 will then protrude significantly above the upper rigid body, and their upper portions are effectively waste material and can be cut off or torn away. The gasket 36 and the legs 42 can be molded from silicone or other resilient material as a unitary part. One leg 42 or more than two legs 42 may be provided, in alternatives.

In order to engage the gasket 36 tightly against the upper rigid body 28*a*, each leg 42 may include a widened portion 44 at a position that lies just beyond the remote end of the corresponding through-hole when the gasket 36 is assembled into the upper rigid body 28*a*. The widened portion 44 has a greater width than through-hole, but the compressible nature of the resilient material from which the gasket 36 is made allows the widened portion to be squashed into a reduced volume so it can be pulled through the through-hole, following the narrower part of the leg 42. Once the widened portion 44 exits the remote end of the through hole, it expands to its original width, wider than the through hole, and hence "locks" the leg in place by inhibiting movement in the reverse direction back into the through hole. In this way, the gasket is also locked in place and kept held against the facing surface of the upper rigid body in its intended position. The surplus leg material is then removed above the widened portion 44.

Figure 10A:
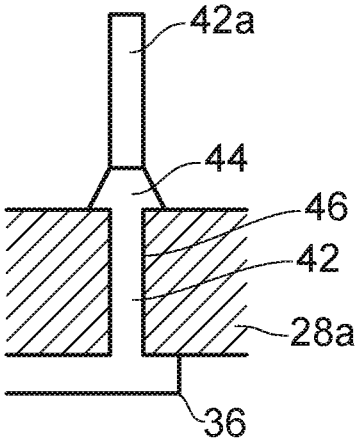
FIG. 10A shows a simplified cross-sectional view through part of the FIG. 10 example.

FIG. 10A shows a simplified cross-sectional view of the gasket 36 installed in position with the upper rigid body 28*a*, with a leg 42 inserted through the through hole 46 in the upper rigid body 28*a* until the widened portion 44 has emerged from the remote end of the through hole 46 and resumed its proper width in excess of the width of the through hole 46. The gasket 36 is in contact with the upper rigid body 28*a* as required. The upper portion 42*a* of the leg 42, above the widened portion 44, can be removed.

Figure 11:
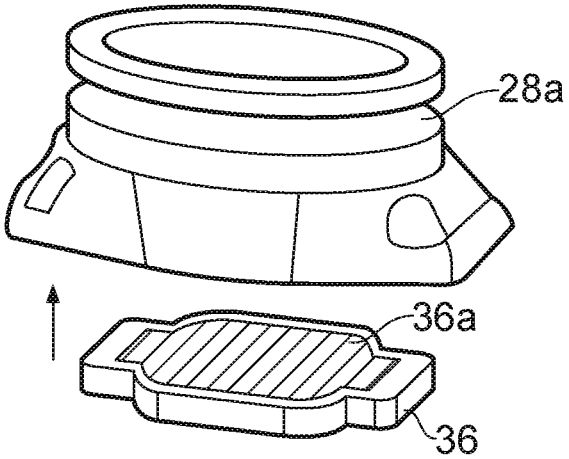
FIG. 11 shows a perspective view of a still further example of a boundary wall upper rigid body and gasket for a vapor chamber.

FIG. 11 shows an external perspective view of another example upper rigid body and gasket, prior to assembly. The upper body 28*a* has the same exterior form as the FIG. 9 example. The gasket 36 also has the same form as the FIG. 9 example, except for the inclusion of a central portion 36*a* which fills the central void intended to be occupied by the vapor chamber in the assembled system. The gasket 36 thus has a planar shape rather than the intended ring shape, and may be considered as a precursor gasket that will be used to provide the final intended ring-shaped gasket. The solid planar shape increases the surface area of the gasket 36, and also increases its stiffness/decreases its flexibility. These properties may make the gasket 36 easier to insert into the upper rigid body 28*a* when assembling the boundary wall. Once the gasket is in position, and possibly also the lower rigid body has been added, the central portion 36*a* of the gasket 36 is removed by being cut, cropped or punched away from the surrounding ring of gasket material.

In a further alternative, if at least one of the rigid bodies is formed from a material suitable for molding, the gasket can be assembled with that rigid body in a two shot (or two step or two stage) injection molding process. Two shot molding enables a single complex shaped item to be molded from two different materials, typically polymers. For the present case, a rigid body can be molded from a first material in a first shot of the process, to create the required shape including any recess for accommodating the gasket. Then, a second material for the gasket is added in a second shot of the process, to be formed by the molding directly onto the already-formed rigid body at the appropriate location. For appropriately compatible materials, this can create a strong bond between the rigid body and the gasket, which is formed as the gasket material solidifies. Hence there is no possibility of leakage between the rigid body and the gasket. Other benefits of this approach include a high consistency of quality between components, since every gasket-rigid body combination will be formed in the same mold and will essentially be identical, and manufacturing times can be brief since two-shot molding can be a rapid process. The gasket is hence securely and accurately positioned with respect to the rigid body. The further rigid body or bodies, plus a wick if included, can then be assembled onto the combined molded item to make the completed boundary wall component.

The examples described in detail above have all utilized an electrical heating element in the form of a wire coil. However, the disclosure is not limited in this regard. Other electrical heating elements may be used, including other wire shapes, planar metal shapes for example cut from sheet metal, traces of metal or other conductive material printed or deposited onto a substrate (which may be a wicking element), or elements formed from other conductive materials, such as ceramics. An electrical heating element may be configured to heat by induction or by resistive current flow. A vapor generator operable by means other than heating may alternatively be used, such as a vibrating perforated plate able to create liquid droplets. In any arrangement, the vapor generator may receive the aerosolizable substrate material from the reservoir via the aperture or apertures with or without a wick or similar porous element.

FIG. 5 introduced the concept of a non-linear aperture, able to accommodate a wick having a bent or curved shape, such as an arch. As discussed, there are a number of attractive features associated with this arrangement. At least some of these can be achieved without the requirement for forming the boundary wall from rigid bodies. Accordingly, the present disclosure is also directed to the general concept of a fluid flow aperture through a boundary wall from a reservoir to a vapor chamber where the aperture has a longitudinal axis which does not lie along a straight line. The various features of curved apertures discussed above with regard to FIG. 5 are applicable to this concept, without any particular requirements for the boundary wall in which the aperture is defined. The boundary wall need not be made from rigid material, or may be made from rigid material in part only. It may or may not comprise rigid bodies secured or sealed together.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in the future.

The invention claimed is:

1. A component for a vapor provision system comprising:

a boundary wall separating a reservoir for holding a fluid from a chamber for housing a vapor generator, the boundary wall comprising two or more adjacent rigid bodies abutted against one another at edges of the adjacent rigid bodies, and sealed to one another at the abutting edges; and a tubular aperture in the boundary wall providing a fluid transport path from the reservoir to the vapor generator;

wherein the aperture is defined between the two or more adjacent rigid bodies, one or more of the adjacent rigid bodies being shaped on their abutting edges to define an opening for the tubular aperture, and the two or more adjacent rigid bodies enclosing a perimeter of the aperture along at least part of a length of the aperture; and wherein the two or more adjacent rigid bodies are sealed to one another by ultrasonic welding, by laser welding, by gluing or by a resilient element interposed between the two or more rigid bodies.

2. The component according to claim 1, wherein the two or more adjacent rigid bodies comprise two adjacent rigid bodies.

3. The component according to claim 1, wherein the boundary wall surrounds the chamber, and the component comprises a second tubular aperture from the reservoir to the chamber on an opposite side of the chamber to the tubular aperture.

4. The component according to claim 1, wherein the tubular aperture is shaped and dimensioned to accommodate a porous member configured to transport fluid from the reservoir to the vapor generator by capillary action.

5. The component according to claim 4, further comprising the porous member positioned in the tubular aperture to transport fluid from the reservoir to the vapor generator by capillary action.

6. The component according to claim 4, further comprising a vapor generator housed in the chamber to receive fluid transported from the reservoir along the tubular aperture.

7. The component according to claim 6, wherein the vapor generator comprises an electrical heating element.

8. The component according to claim 1, wherein the tubular aperture is shaped and dimensioned to transport fluid from the reservoir to the vapor generator by capillary action.

9. The component according to claim 1, wherein the two or more adjacent rigid bodies are formed from one or more of polybutylene terephthalate, glass-fiber reinforced thermoplastic, polyether ether ketone, polypropylene, copolyester, metal, and glass.

10. The component according to claim 9, wherein each of the two or more adjacent rigid bodies is formed from the same material.

11. The component according to claim 1, wherein there is a bend in a length of the tubular aperture such that an angle between a longitudinal axis of a first portion of the length and a longitudinal axis of a second portion of the length is less than 180°.

12. The component according to claim 11, wherein the angle is in the range of 80° to 100°.

13. The component according to claim 1, wherein the two or more adjacent rigid bodies enclose the perimeter of the tubular aperture along whole length of the tubular aperture.

14. The component according to claim 1, further comprising a gasket formed from resilient material interposed between two of the two or more adjacent rigid bodies such that the gasket forms part of the perimeter of the tubular aperture along part of a length of the tubular aperture.

15. The component according to claim 14, wherein the gasket is formed from silicone, thermoplastic elastomer, or thermoplastic polyurethane.

16. The component according to claim 14, wherein the gasket forms part of the perimeter of the tubular aperture where the tubular aperture opens into the chamber.

17. The component according to claim 16, wherein the gasket has a ring shape and circumscribes the chamber between two of the two or more adjacent rigid bodies.

18. The component according to claim 14, wherein the gasket is bonded to one of the two or more adjacent rigid bodies by a two shot injection molding process.

19. The component according to claim 1, further comprising the reservoir.

20. The component according to claim 1, wherein the component is, or is comprised in, a cartridge configured to be coupled to a device comprising an electrical power supply for supplying electrical power to the cartridge when coupled to form a vapor provision system.

21. A vapor provision system comprising the component according claim 1.

* * * * *